United States Patent [19]

Nichols

[11] Patent Number: 4,623,020

[45] Date of Patent: Nov. 18, 1986

[54] COMMUNICATION JOINT FOR USE IN A WELL

[75] Inventor: Randy P. Nichols, Humble, Tex.

[73] Assignee: Cactus Wellhead Equipment Co., Inc., Houston, Tex.

[21] Appl. No.: 654,344

[22] Filed: Sep. 25, 1984

[51] Int. Cl.[4] ..... E21B 33/03; E21B 33/038

[52] U.S. Cl. ..... 166/88; 166/75.1; 166/375; 285/140

[58] Field of Search ..... 166/88, 89, 348, 349, 166/368, 86, 379, 378, 375, 360, 75.1; 285/140–143

[56] References Cited

U.S. PATENT DOCUMENTS

| | | | |
|---|---|---|---|
| 2,766,830 | 10/1956 | Church | 166/86 |
| 3,780,802 | 12/1973 | Phipps et al. | 166/89 |
| 3,965,977 | 6/1976 | Beson | 166/88 |
| 4,125,155 | 11/1978 | Brock, Jr. | 166/85 X |
| 4,202,410 | 5/1980 | Quebe | 166/88 |
| 4,333,526 | 6/1982 | Watkins | 166/87 |
| 4,390,063 | 6/1983 | Wells, Jr. | 166/88 X |
| 4,449,583 | 5/1984 | Lawson | 166/332 X |
| 4,458,903 | 7/1984 | Tohill | 166/75.1 X |
| 4,552,213 | 11/1985 | Boyd et al. | 166/88 |

*Primary Examiner*—Stephen J. Novosad
*Assistant Examiner*—David J. Bagnell
*Attorney, Agent, or Firm*—Eugene L. Flanagan, III

[57] ABSTRACT

A communication joint for use in a well is disclosed. The communication joint includes a one-piece tubular body having an exterior surface adapted to form a slidable fluid seal with a wellhead member of the well. The tubular body includes first and second fluid conduits extending axially along and positioned in the tubular body, each conduit providing a fluid passageway independent of the other fluid conduit. Preferably, the first and second fluid conduits extend axially above and below the exterior surface of the body.

15 Claims, 3 Drawing Figures

COMMUNICATION JOINT FOR USE IN A WELL

BACKGROUND OF THE INVENTION

The present invention relates to wellhead apparatus forming a slidable fluid-tight seal with a wellhead member, for example, in an oil and/or gas well or a geothermal well.

The wellhead of an oil or gas well serves in part to maintain control over fluid pressure in the well at the surface and to suspend tubing and casing in the well from the surface. It is sometimes desirable to reciprocate the tubing at the wellhead in order to, for example, pull out of or sting into a permanent packer, or to operate downhole tools. At the same time, it is necessary to maintain a fluid-tight seal between the tubing and the wellhead as the tubing is being reciprocated. In the prior art, this was achieved by suspending a joint of production tubing from a wellhead member, such as an adaptor or bonnet positioned above and removably affixed to a tubing head. The tubing head is immovably affixed to the wellhead and has a pack-off device positioned within its bore. The pack-off device forms a slidable seal with the tubing joint permitting it to be reciprocated into and from the well without loss of control over fluid pressure in the annulus between the tubing joint and the casing. A tubing string is suspended from the tubing joint so that it can be reciprocated, for example to pull out of or sting into a permanent packer.

The foregoing arrangement does not permit additional fluid communication lines to be run downhole through the pack-off. Such communication lines are provided, for example, to permit control at the wellhead over various pressure operated downhole tools and instruments, such as pressure operated safety valves and pressure measuring instruments. To achieve such a capability in prior art wellhead arrangements, a tubing head is immovably affixed at the wellhead and a pack-off device is positioned within the bore of the tubing head to form a seal against a reciprocable shroud made up on a coupling which also serves to suspend the tubing within and spaced from the shroud. Accordingly, an annular space is thus defined between the outer surface of the tubing and the inner surface of the shroud. This space serves to accommodate relatively small diameter fluid pressure lines extending from the wellhead downhole, for example, for the operation of a tool, such as a safety joint, or an instrument, such as a pressure measuring device, downhole. The coupling from which the shroud and the tubing are suspended is, in turn, affixed to an adapter having a flange which can be bolted to the tubing head to form a seal thereagainst, and can be unbolted from the tubing head to permit the tubing to be reciprocated upwardly. The adapter also includes ports therethrough which provide communication to the pressure lines through respective fluid conduits formed axially in the body of the coupling intermediate its central bore and its outer surface. The lines extending downhole between the tubing and the shroud suspended from the coupling, are affixed thereto at its lower extremity.

In order to permit the tubing to be reciprocated a sufficient distance, often as much as twenty-four feet, it is necessary for the shroud to provide an outer sealing surface which extends axially in excess of the distance it is desired to reciprocate the tubing. Because this sealing surface must be so long, the prior art shroud is made up of several sections of tubing threaded, welded or soldered together. At each location where the joints are threaded together, leaks can occur. In addition, it is relatively time consuming to make up the tubing to the coupling, the various pressure lines to the coupling, as well as the various sections of shroud to one another and to the coupling, and test each threaded joint for leaks. Where the sections are welded or soldered together they are subjected to stress due to heating which can lead to weld failure and leakage at the wellhead. In addition, because an annular space is defined between the shroud and the tubing, it is necessary to limit the test pressure applied to the outside of the shroud to test the integrity of the seal formed with the packoff and tubing head and the seal between the tubing head and the adapter. Since the wellhead cannot be tested at pressures exceeding the foregoing limit, the usefulness of this arrangement is limited to wells which are not likely to experience greater pressures at the wellhead. A further possibility is that the shroud will burst or the tubing collapse if subjected to high well pressures which sometimes are experienced at the wellhead due, for example, to gas leakage into the tubing/casing annulus.

SUMMARY

In accordance with one aspect of the present invention a wellhead assembly is provided for a well, such as an oil or gas well, or a geothermal well. The wellhead assembly includes a wellhead member including means for immovably affixing the wellhead member to a wellhead of the well, the wellhead member having an opening therethrough adapted to form a slidable seal with an outer surface of a communication joint positioned in the opening. The communication joint includes a one-piece tubular body having an outer surface forming the slidable seal with the wellhead member. The tubular body has a first passage therein capable of conveying fluids therethrough and a second passage independent of the first passage and capable of conveying fluids through the tubular body, the second passage being positioned in the body between the first passage and the outer surface. Since the one-piece tubular body forms the seal with the wellhead member, there are no threaded connections therein which can leak when lifted above the seal, or which require testing under pressure to ensure that they will not leak before installation in the wellhead. In addition, by providing a second fluid passage independent of the first fluid passage, the second fluid passage can provide an independent means for communicating fluid pressure downhole past the seal to a subsurface tool or instrument. It is, thus, possible to dispense with the need to make up the shroud and pressure test the threaded couplings, and it is unnecessary to run the pressure lines between the shroud and the tubing therein, so that an additional and separate fluid coupling above the shroud can be avoided. Since the fluid passages are positioned in the one-piece body, the problems associated with the presence of an annulus between a shroud and a tubing joint are avoided.

In accordance with another aspect of the present invention, a communication joint is provided for use in a well. The communication joint includes a one-piece tubular body having an exterior sealing surface adapted to form a slidable fluid seal with a wellhead member of the well. The tubular body includes first and second conduits extending axially along and positioned in the tubular body, each conduit having the capability of providing a fluid passageway independent of the other conduit. Through the provision of a one-piece body having independent conduits for tubing conveyed fluids and for coupling fluids to and from downhole pressure lines, it is possible to dispense with the need in the prior art for making up the tubing to a coupling, making up several lengths of fluid pressure lines to a coupling, and assembling a multi-piece shroud and making it up as well to the coupling in order to assemble a communication joint for use at the wellhead. Once again, the problems associated with leakage at multiple threaded, welded or soldered connections are avoided.

In accordance with still another aspect of the present invention, a communication joint for use in a well is provided. The communication joint has a solid body having an exterior surface adapted to form a slidable fluid seal with a wellhead member of the well. The solid body includes first and second conduits positioned in and extending axially within the solid body, each conduit having the capability of providing a fluid passageway independent of the other conduit. Since the conduits are positioned in the solid body, there is no need to provide a tubing joint for a production flow path and separate pressure lines, for example, for controlling downhole safety valves. Thus, there is no need for a shroud outside the pressure lines for forming the slidable seal and no consequent need to have an annulus between the shroud and the tubing. The number of parts that need to be assembled at the well site are reduced. Since leaks normally occur at threaded connections much more frequently than through the wall of a solid body, the likelihood that leaks will occur in use at the wellhead is reduced.

In accordance with yet another aspect of the present invention, a wellhead assembly for a well includes a wellhead member having means for immovably affixing the wellhead member to a wellhead of the well. The wellhead member has an opening therethrough adapted to form a sliding seal with an outer surface of a communication joint positioned in the opening. The communication joint includes a solid body having an outer sealing surface forming the slidable seal with the wellhead member. The solid body has a first conduit therein and a second conduit independent of the first conduit and positioned in the solid body between the first conduit and the outer sealing surface.

BRIEF DESCRIPTION OF DRAWINGS

The present invention, as well as further objects and features thereof, will be understood more clearly and fully from the following description of certain preferred embodiments when read with reference to the accompanying drawings, wherein.

DETAILED DESCRIPTION OF CERTAIN PREFERRED EMBODIMENTS

Figure 1:
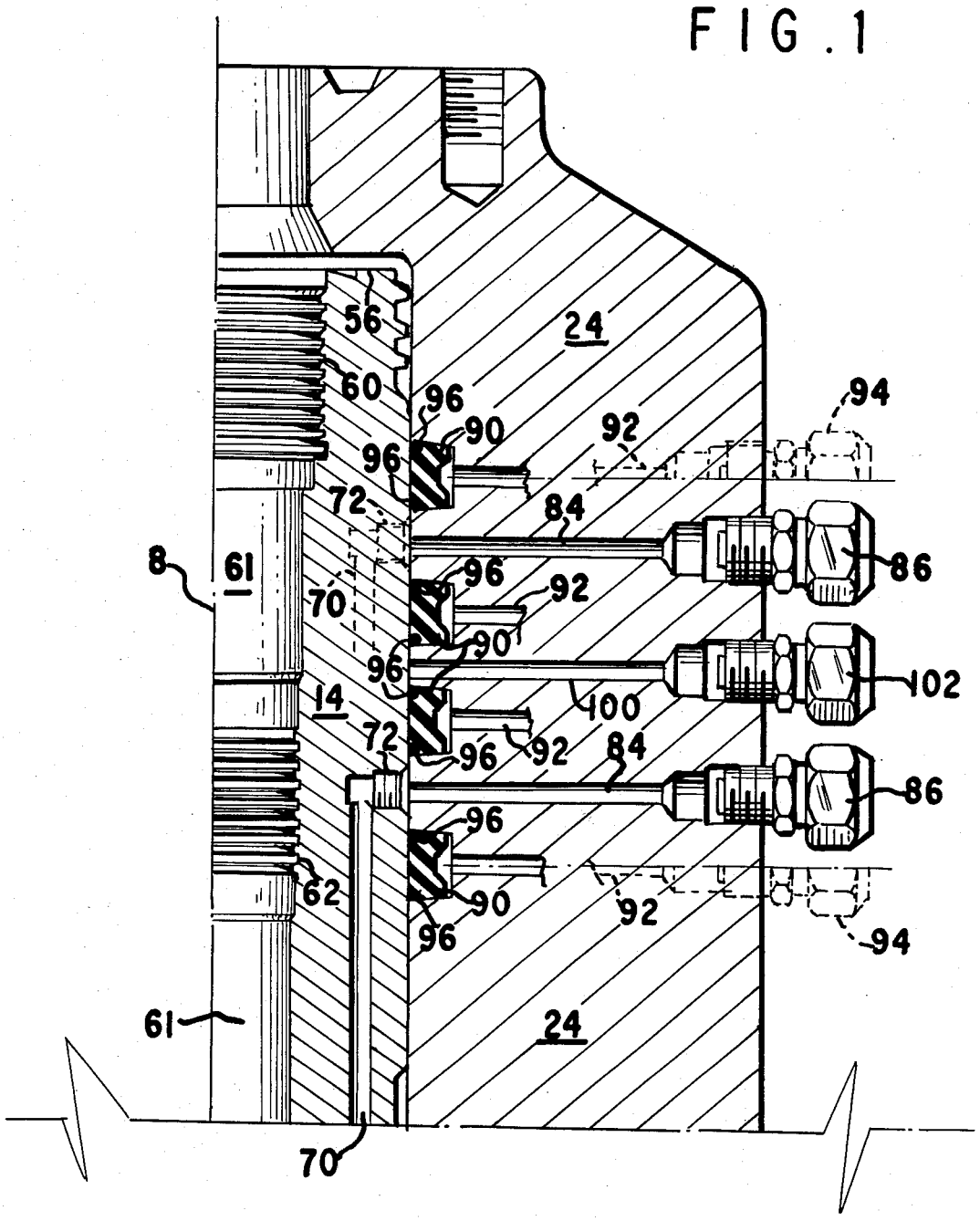
FIGS. 1, 2 and 3 are partial cross-sectional views of contiguous portions of a wellhead assembly, incorporating the features of the present invention.

With reference to the drawings, a wellhead assembly for an oil and/or gas well is illustrated in cross section; only that portion of the assembly to the right of the center line 8, is shown, the left hand portion thereof being identical to the right hand portion. A tubing head 10 is immovably affixed to the wellhead (FIG. 2) and supports an annularly shaped pack-off device 12 which serves to provide a slidable seal against an outer surface 16 of a one-piece, solid tubular body of a communication joint 14. The communication joint 14 is supported at the wellhead by an annular suspension nut 20, which in turn is coupled by a threaded connection to an adapter member 24; member 24 serves to support the suspension nut 20 through the threaded connection.

The tubing head 10 may be, for example, a Type C tubing spool; the pack-off 12 may be, for example, a Type C tubing hanger; and the adapter 24 may, for example, be a Type CSJ adapter, all sold by GEO Cactus Wellhead Equipment Company, Houston, Tex., U.S.A.

Figure 2:
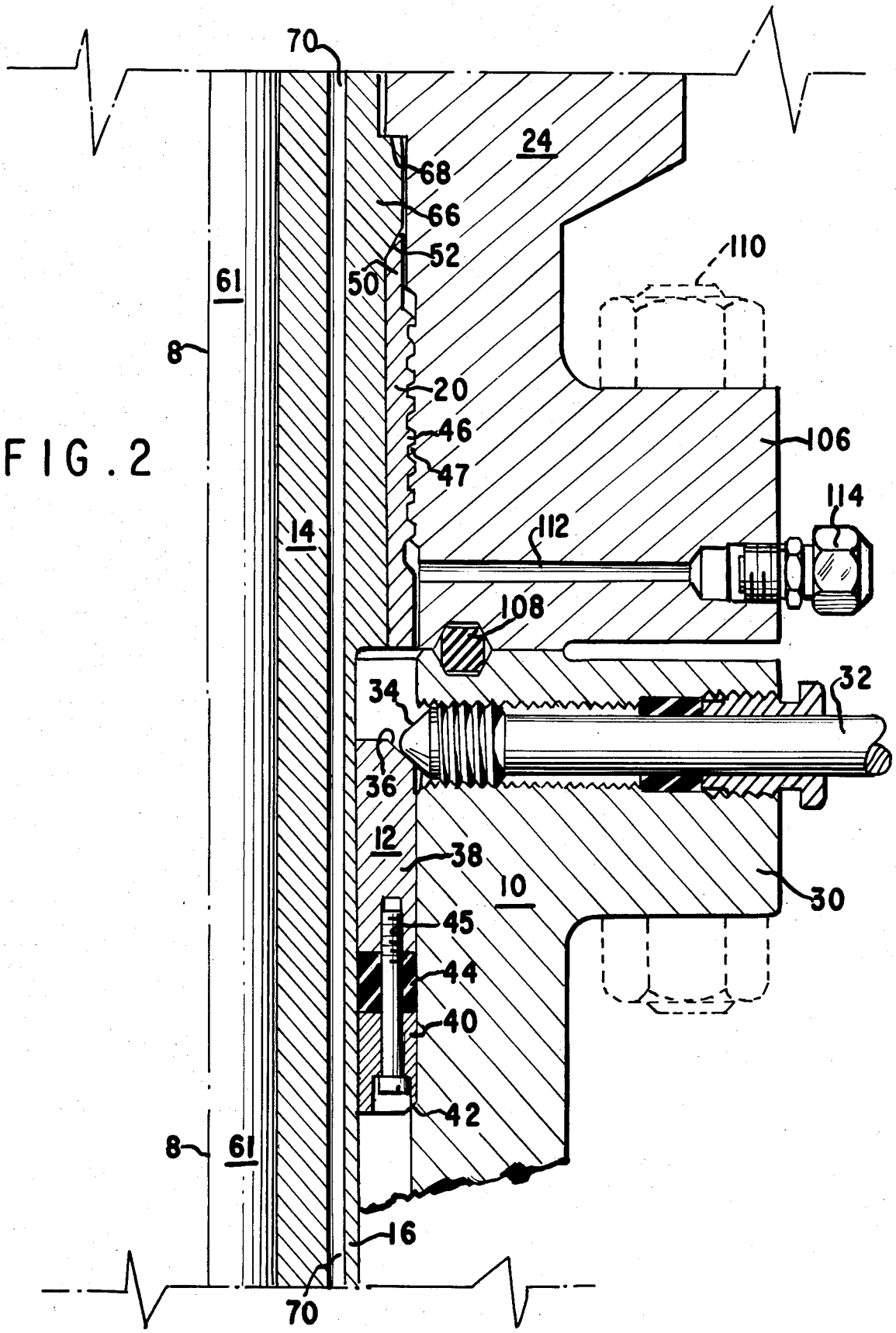

With reference to FIG. 2, the tubing head 10 includes a radially outwardly extending flange 30 having a radial bore extending therethrough and into which is threaded a conventional lock screw 32 having a generally conically shaped, inwardly extending end 34 shown abutting a cam surface 36 of an upper annular portion 38 of the pack-off 12. The pack-off 12 also includes a lower annular portion 40 supported in a shoulder 42 of the tubing head 10, and an elastomeric seal ring 44 compressed between the upper and lower portions 38 and 40 of the pack-off 12. A number of bolts 45 serve to maintain the various elements of the pack-off 12 together. When the lock screw 32 is advanced inwardly, the inner end 34 thereof forces the upper portion 38 of pack-off 12 downwardly, thus to compress the seal ring 44 against the lower portion 40, to thereby form a seal against the outer surface 16 of the body of the communication joint 14.

The suspension nut 20 is provided with threads 46 on its outer surface intermediate of the ends of the suspension nut 20. Threads 46 are enmeshed with opposing threads 47 on an inner surface of adapter 24. Extending upwardly from the threaded portion of the suspension nut 20 is an annular projection 50 having an inwardly facing, frusto-conical surface 52 extending inwardly and downwardly from the upper extremity of projection 50 and forming an angle with the central axis of the suspension nut 20 of 30°. The outer diameter of the projection 50 is selected so that when the expansion nut 20 is threaded into the adapter 24 and in the absence of force exerted against the surface 52, the outer surface of the projection 50 is spaced slightly from the opposing inner surface of the adapter 24. Moreover, the spacing between the outer surface of the projection 50 and the inner surface of the adapter 24 is selected so that when the projection 50 is deflected outwardly as force is applied to the surface 52, its elastic limit will not be exceeded before it abuts the inner surface of adapter 24. Accordingly, when the load is removed from the surface 52, the projection 50 will assume its original shape, permitting the suspension nut 20 to be removed from the adapter 24 easily by reversing out the threads 46. The annular thickness of the projection 50 is selected so that under normal load conditions, as described herein below, the projection 50 will be displaced outwardly sufficiently to contact the inner surface of the adapter 24. Since the outer surface of the projection 50 is thereby forced against the inner surface of the adapter 24, a frictional force is produced thereby tending to prevent the suspension nut 20 from backing out of the adapter 24.

As noted hereinabove, the communication joint 14 is comprised of a solid, one-piece tubular body. Preferably, the body is fabricated from a single piece of material, although it may also be fabricated of several pieces joined together, for example, by welding. It is preferable to fabricate the body 14 from a single piece of material since this avoids the possibility that leaks may occur at the welds. The tubular body extends from an upper end 56 received within the adapter 24, to a lower end 58 (FIG. 3) provided with a pin type threaded coupling from which a tubing string suspended in the well is supported. Accordingly, the communication joint 14 serves, in part, as a tubing hanger. The upper end 56 of the one-piece body is provided with a box type coupling 60 which permits a joint of tubing to be attached thereto in order to lift the communication joint (and the suspended tubing string) to permit the tubing string to be reciprocated in the well for various purposes, such as stabbing into or pulling out of a permanent packer downhole. While the communication joint and suspended tubing are thus either being lifted or lowered from or into the well, the seal 44 maintains control at the wellhead of fluid pressure outside the communication joint 14 in the well. Accordingly, the seal provided by the seal ring 44 against the surface 16 is a sliding seal.

The communication joint 14 has a central bore 61 formed in the solid body thereof and in communication with the tubing suspended therefrom. The central bore 61 provides a fluid passageway for conducting production fluids, well stimulation fluids and the like between the wellhead and the tubing. In order to maintain control over tubing pressure, a further set of threads 62 are provided on the inner surface of the body of the communication joint 14 to permit a plug to be set therein thus to isolate fluid pressure in the tubing therebelow from the wellhead. This may be desirable, for example, when the tubing is being reciprocated into or from the well by manipulation of the communication joint 14, in order to maintain control of pressures within the tubing.

The body of the communication joint 14 is provided with a flange 66 extending from an upwardly facing shoulder 68 abutting a corresponding, downwardly facing shoulder of the adapter 24, to a lower, frustoconical surface parallel with an abutting surface 52 of suspension nut 20, whereby the communication joint 14 and the tubing string suspended therefrom are supported. In this manner, the weight of the communication joint 14 and the tubing supported thereby is exerted against the surface 52 of the suspension nut 20, thus to deflect its upper projection 50 outwardly, as discussed above.

Figure 3:
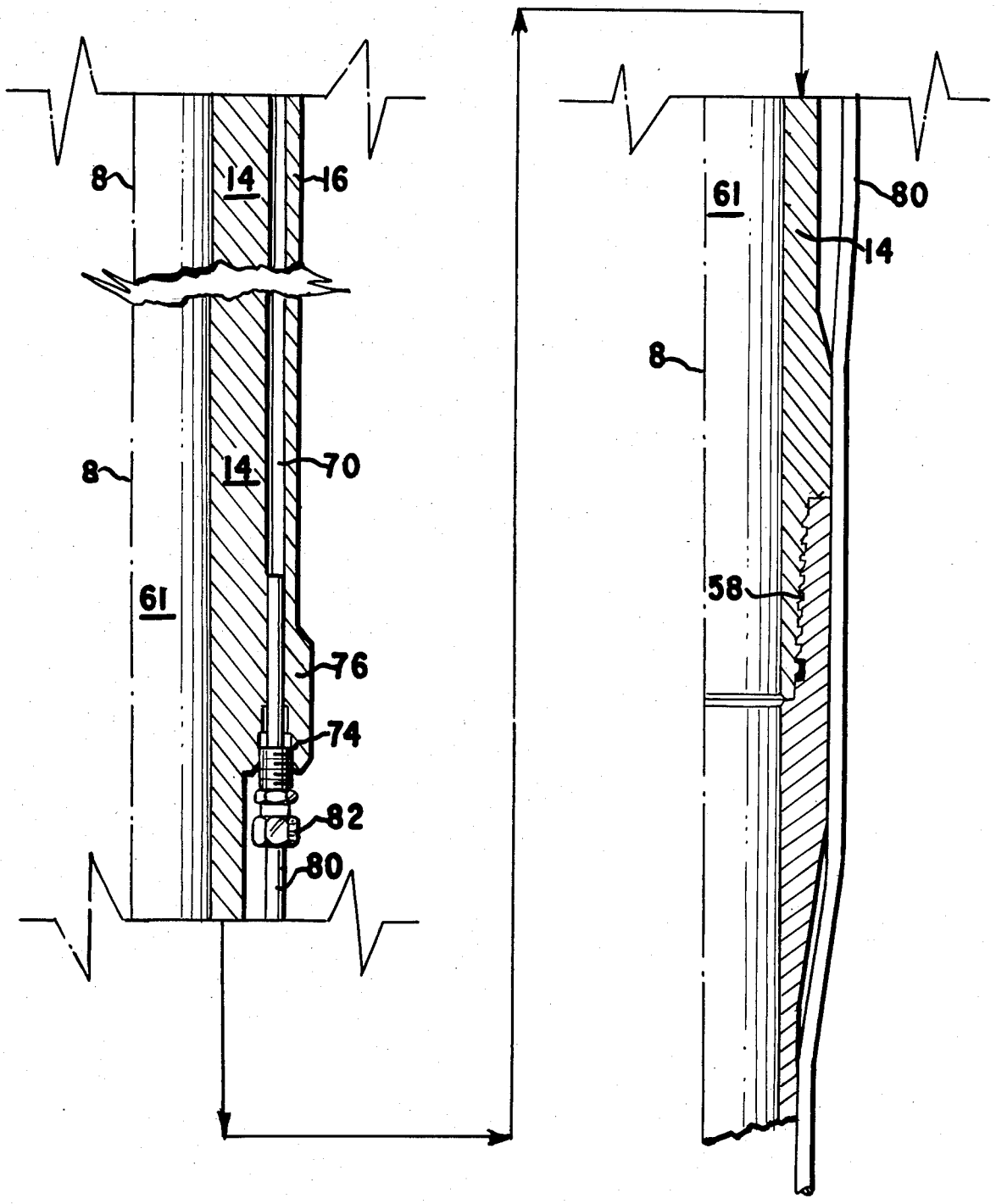

In order to provide additional fluid communication paths from the wellhead downwardly past the seal 44, or in the alternative, to provide electrical communication between the wellhead and the interior of the well, a plurality of conduits 70 are formed axially in the solid, one-piece body of the communication joint 14 between the central bore 61 and the outer surface 16 and extend within that body from respective upper ports 72 formed between the conduits 70 and the outer surface of the one-piece body, to a second set of lower ports 74 formed in a downwardly facing annular surface of a lower flanged portion 76 adjacent the lower end 58 of the communication joint 14. In the embodiment of FIGS. 1–3, the conduits 70 serve to communicate fluid under pressure from the wellhead downwardly past the seal 44 to respective subsurface lines 80 in fluid communication with the conduits 70 through fluid couplings 82 threaded to the ports 74. The lines 80 extend downhole to one or more tools or instruments, such as subsurface control valves or pressure measuring instruments, either to provide fluid under pressure for operating such tools or to provide fluid communication with downhole instruments. It will be appreciated that the fluid passages provided by the conduits 70 are independent of the fluid passage provided by the central bore 61.

The conduits 70 may be formed in the one-piece body of the communication joint 14 by any of a variety of methods. For example, each conduit 70 may be drilled through the one-piece body. In the alternative, each conduit 70 may be formed by milling an axially extending groove in the outer surface 16 of the communication joint 14, positioning a tubing, for example, of the same type as tubing 80, along the extent of the groove and then welding an insert into the exterior of the groove so that it then forms one-piece with the body of the communication joint 14. The conduits 70 each have a relatively smaller cross section than the central bore 61.

The adapter 24 provides means for establishing fluid communication with the conduits 70, while isolating the fluid pressure in each conduit 70 from the other conduits 70. In particular, the adapter 24 is provided with a plurality of ports 84 each in fluid communication with a respective conduit 70 through its port 72. Each of the ports 84 is provided with a threaded coupling adjacent an outer surface of the adapter 24 in which is threaded a respective check valve 86, which may, for example, be a Type K device sold by GEO Cactus Wellhead Equipment Company, Houston, Tex., U.S.A. Each of the check valves 86 is adapted upon rotation to the desired position thereof to either seal off the port 84 completely, or merely act as a check valve.

The adapter 24 is provided with a number of elastomeric seals 90 spaced axially along its inside diameter and serving to isolate each of the ports 72 and the corresponding conduit 70 from the other ports 72 and conduits 70 at the wellhead. Each of the elastomeric seals 90 is coupled through a respective port 92 with the exterior of the adapter 24 through a respective additional check valve 94 of the same type as the check valves 86. The elastomeric seals 90 are of the type which is energized by the injection of plastic through the check valves 94 and the ports 92 to press inwardly against an outer surface of the elastomeric seal 90. In order to prevent the seals 90 from extruding axially between the outer surface of the communication joint 14 and the inner surface of the adapter 24, each seal 90 is provided with two non-extrusion rings 96 one positioned at the upper, inner extremity of the seal 90 and the other positioned at the lower, inner extremity of the seal 90. A test port 100 is formed in the adapter 24 extending from the outer surface thereof to its inner surface between two of the seals 90 and having a threaded coupling at its outer extremity receiving yet another check valve 102 of the same type as the check valves 86 and providing a means of pressure testing the integrity of the seals 90 on either side thereof.

When the communication joint 14 is at its lowermost position, a lower flange 106 of the adapter 24 is sealed against the flange 30 of the tubing head 10 by a standard API-Type seal ring 108 captured in opposed grooves formed in the flanges 30 and 106. The adapter 24 is then coupled to the tubing head 10 by means of a plurality of bolts 110 joining the flange 30 to the flange 106 and exerting a compressive force thereagainst to maintain the fluid-tight seal against the ring 108. The integrity of this seal can be pressure tested by the application of fluid pressure through a test port 112 formed in flange 106 and closed by a further check valve 114.

Various modifications may be made within the scope of the present invention. For example, two communication joints of the type herein described can be positioned in parallel at the wellhead and run or retrieved simultaneously or separately.

It will be appreciated that numerous advantages over the prior art are provided by the present invention. Since the communication joint is provided as a one-piece body of material, there are no threaded couplings between individual sections thereof which might leak when the communication joint is lifted upwardly with respect to the seal 44. In addition, it is unnecessary to assemble the communication joint at the well site, as is typically done in the prior art, wherein the same function is provided by a multi-piece shroud threaded to an upper coupling and enclosing an additional joint of tubing therein threaded to the coupling as well as individual pressure lines extending downwardly past the seal at the wellhead. Also, the present invention dispenses with the need to have an annulus between a shroud and a tubing joint, so the associated disadvantages are avoided.

The terms and expressions which have been employed are used as terms of description and not of limitation, and there is no intention in the use of such terms and expressions of excluding any equivalents of the features shown and described, or portions thereof, it being recognized that various modifications are possible within the scope of the invention claimed.

I claim:

1. A wellhead assembly for a well, comprising:

a wellhead member including means for immovably affixing the wellhead member to a wellhead of the well, the wellhead member having an opening therethrough adapted to form a slidable seal with an outer surface of a communication joint positioned in the opening;

a communication joint positioned in the opening and forming a slidable seal with the wellhead member such that the communication joint may slide within the wellhead member while maintaining the seal therewith;

the communication joint including a one-piece tubular body having an outer surface forming the slidable seal with the wellhead member the tubular having a first fluid passage therein capable of conveying fluids therethrough and a second passage independent of the first passage and capable of conveying fluids through the tubular body, the second passage being positioned in the body between the first passage and the outer surface.

2. The wellhead assembly of claim 1, wherein the first and second passages extend from above the slidable seal to below the slidable seal.

3. The wellhead assembly of claim 1, wherein the first passage is coupled to a tubing string in the well for communicating fluids to or from the tubing string.

4. The wellhead assembly of claim 3, wherein the second passageway is coupled to one end of a fluid pressure line extending therefrom to a downhole tool for controlling the tool by fluid pressure.

5. The wellhead assembly of claim 3, wherein the second passageway is coupled to one end of a fluid pressure line extending therefrom to a downhole instrument for use in measuring fluid pressure.

6. A communication joint for use in a well, comprising:

a one-piece tubular body having an exterior sealing surface adapted to form a slidable fluid seal with a wellhead member of the well such that the tubular body may slide within the wellhead member while maintaining the seal therewith;

the tubular body including first and second conduits extending axially along and positioned in the tubular body, each conduit having the capability of providing a passageway independent of the other conduit.

7. The communication joint of claim 6, wherein the first and second conduits extend axially above and below the exterior sealing surface of the tubular body.

8. The communication joint of claim 6, wherein the first conduit extends axially through the center of the one-piece body.

9. The communication joint of claim 8, wherein the second conduit has a cross-sectional area smaller than that of the first conduit and extends axally within the one-piece body between the first conduit and the exterior surface of the body.

10. The communication joint of claim 6, wherein the first conduit extends axially from a first end of the tubular body to a second end thereof, and the tubular body has a first port extending through an outer wall of the tubular body adjacent its first end and a second port extending through an outer wall of the tubular body adjacent its second end, the second conduit extending axially through the tubular body between and in communication with the first and second ports.

11. The communication joint of claim 6, wherein the one-piece body is produced from a single piece of material.

12. A communication joint for use in a well, comprising:

a solid body having an exterior surface adapted to form a slidable fluid seal with a wellhead member of the well such that the solid body may slide within the wellhead member while maintaining the seal therewith;

the solid body including first and second conduits positioned in and extending axially within the solid body, each conduit having the capability of providing a fluid passageway independent of the other conduit.

13. The communication joint of claim 12, wherein the solid body is produced from a single piece of material.

14. The communication joint of claim 12, wherein the first and second conduits extend axially above and below the exterior sealing surface of the body.

15. A wellhead assembly for a well, comprising:

a wellhead member including means for immovably affixing the wellhead member to a wellhead of the well, the wellhead member having an opening therethrough adapted to form a slidable seal with an outer surface of a communication joint positioned in the opening:

a communication joint positioned in the opening and forming a slidable seal with the wellhead member such that the communication joint may slide within the wellhead member while aintaining the seal therewith;

the communication joint including a solid body having an outer sealing surface forming the slidable seal with the wellhead member;

the solid body having a conduit therein and second conduit independent of the first conduit and positioned in the solid body between the first conduit and the outer sealing surface.

* * * * *